US005493736A

United States Patent [19]

Allison

[11] Patent Number: 5,493,736

[45] Date of Patent: Feb. 27, 1996

[54] SPORTS HELMET PROTECTIVE DEVICE

[76] Inventor: Norman E. Allison, R.D. 2, Atco, N.J. 08004

[21] Appl. No.: 394,420

[22] Filed: Feb. 24, 1995

[51] Int. Cl.[6] ..... A41D 13/00

[52] U.S. Cl. ..... 2/416; 2/2; 2/411; 2/421; 2/425

[58] Field of Search ..... 2/2, 410, 424, 2/411, 425, 415, 416, 44, 45, 421, 422; 602/5, 12, 16, 17, 18, 19; 128/870

[56] References Cited

U.S. PATENT DOCUMENTS

| | | | |
|---|---|---|---|
| 2,474,200 | 6/1949 | McBee | 128/87 |
| 3,134,106 | 5/1964 | Shaffer et al. | 2/2 |
| 3,189,917 | 6/1965 | Sims | 2/3 |
| 3,818,509 | 6/1974 | Rono et al. | 2/421 |
| 5,005,563 | 4/1991 | Veale | 128/75 |
| 5,123,408 | 6/1992 | Gaines | 602/17 |
| 5,261,125 | 11/1993 | Cartwright et al. | 2/421 |
| 5,353,437 | 10/1994 | Field et al. | 2/425 |

*Primary Examiner*—C. D. Crowder
*Assistant Examiner*—Larry D. Worrell, Jr.
*Attorney, Agent, or Firm*—Thomas A. Lennox

[57] ABSTRACT

A modified football helmet has an inner cap attached by elastic straps to the inside of the helmet shell providing a space above the cap. The helmet is further modified incorporating a rigid collar extending outwardly from the bottom of the helmet which has a lower surface positioned a distance above two upright post members extending upwardly from the rigid shoulder pads.

17 Claims, 2 Drawing Sheets

SPORTS HELMET PROTECTIVE DEVICE

BACKGROUND OF THE INVENTION

This invention is directed to a helmet and stop combination device for use by sports participants.

One of the long-standing concerns in contact sports is the serious injuries, including concussions, paralysis, or even death, resulting from impact to the head. Among the most serious injuries are caused by blows to the top of the head which are strong enough to compress or even break the person's neck or spine. While the sport of football comes immediately to mind, other sports, such as skiing, ice hockey, or even competitive bicycle riding take their toll.

In these types of injuries, even if the person is wearing a modern helmet protection, the heaviest blows transmit the impact to the neck and the upper spine. Therefore, to a significant extent, the modern helmet which tends to give the participant a false sense of invincibility merely transfers the danger of injury from the head to the spine. Further, despite penalties and rules, the participant, in the heat of football competition, commonly uses the helmeted head as a weapon to defeat the opponent.

Common approaches to the problem include foam neck braces which are worn on top of shoulder protection and tend to cushion the impact, particularly for blows to the side of the head. However, these devices have virtually no effect on impacts to the top of the head which are transmitted directly to the spine.

In U.S. Pat. No. 3,189,917 to Sims, a protective device is illustrated with a resilient foam rubber collar or an inflatable collar which is large enough to contact the lower edge of the helmet shell. The use of the device is illustrated by a forearm blow to the players face causing contact of the helmet with the rear portion of the collar. In U.S. Pat. No. 5,123,408 to Gaines, a sports helmet is braced by direct connection between the helmet and a force distributing device worn over the shoulder for protection of the cervical spine. In U.S. Pat. No. 5,005,563, to Veale, a mobile-cervical extension and supporting apparatus is provided for an injured person to immobilize the head, neck, and sternum in proper alignment subsequent to an injury as a result of trauma. An older version is described in U.S. Pat. No. 2,474,200 to McBee describing a cervical splint to immobilize the patient's head and neck after an injury.

None of the above devices satisfy the needs described above nor attain the objects described herein below.

SUMMARY OF INVENTION

It is an object of the present invention to transfer the force of impacts to the head, specifically blows to the top of the head to other areas of the body, such as to the shoulders, so that the head and neck are protected from trauma. While the drawings and the preferred embodiments are directed to an apparatus suitable for use for a football player, the invention is not so limited. Modern helmets for skiers, ice hockey players, or bicycle riders offer virtually no protection to the neck and spine of the participant. The helmet construction and the shoulder pad construction, as illustrated, would be substantially modified to suit the needs of these other sports. For example, for the skier, the apparatus on the shoulder does not require such padding protection, but includes a mechanism to distribute the force from the helmet to the wearer's shoulders. In some cases, such as for hockey player's shoulder pads, essentially no additional shoulder pads would be necessary to utilize this invention.

It is an object of the present invention to provide a device to substantially reduce the risk of severe neck and spine injuries. While no device can give absolute protection, an object of the invention is to substantially reduce the risk of injuries caused by blows to the top of the head which tend to compress the person's spine.

It is an additional object of the present invention to provide a device that does not interfere with the playing of the sport and essentially only comes into operation when a substantial blow to the top of the head occurs. In particular, it is an object to provide the device that allows essentially unimpeded movement of the neck.

It is an additional object of the protection sought to provide a device which may be easily adjusted or modified to the size of the participant.

It is a particular object of the present invention to provide a combination helmet and stop mechanism that allows standard cushioning and movement of the head within the helmet, but prevents any further movement of the head within the helmet upon reaching a certain closeness of impact by transferring most of the force to the shoulders and back of the participant.

It is a particular object of the present invention to provide a protection device that is not unyielding or intrusive of the appearance and utility of the participant in the sports activity.

An aspect of the invention is a protection apparatus to be worn by a person participating in a sport. The apparatus includes a helmet fitting over the head of the person. The helmet includes a rigid outer shell of a size and shape to encompass a major portion of the person's head. The shell includes an inside surface defining an interior cavity bounded by an inside upper surface section and, an inside side surface section around the perifery of the inside surface, and an outer surface having a lower section. The helmet further includes a cap of a size and shape to extend over an upper portion of the person's head. The helmet also includes attachment means connecting the cap peripherally to the inside side surface section of the shell and providing elastic resistance against movement of the cap upwardly a first distance to the inside upper surface section of the shell. The helmet further includes an rigid annular collar attached to and extending outwardly from the lower section of the outer surface of the shell, the collar including a firm lower horizontal surface. The apparatus further includes force distribution means on shoulders of the person to distribute a downwardly directed force over an area of the person's body, and a pair of vertical members attached on top of the force distribution means, each of the members being positioned over opposite shoulders of the person and including an upper end surface positioned a second distance under the lower horizontal surface of the collar. The first distance is less than the second distance.

It is preferred that the helmet also include padding means on the interior surface of the shell to provide a cushion against the person's head, said means defining the interior cavity. It is further preferred that the firm lower horizontal surface of the collar include an outer partial circular edge. It is also preferred that the difference between the first distance and the second distance be about one inch. It is further preferred that the first distance be about two inches and the second distance be about three inches. It is also preferred that the force distribution means comprises shoulder pads comprising rigid panels on shoulders of the person. It is further preferred that the annular collar be an integral extension of the shell extending outwardly from a lower edge of the lower section of the shell. It is also preferred that the apparatus further comprises a pair of brackets attached on top of the force distribution means, each bracket over opposite shoulders of the person and the vertical members interfit into and are detachably attached to each respective bracket. It is more preferred that the pair of vertical members be of a chosen length to attain the second distance. It is further preferred that the attachment means connecting the cap peripherally to the inside side surface section of the shell include a plurality of elastic straps, each strap attached at a first end abutting a first surface to the cap and at a second end abutting the first surface to the shell.

Another aspect of the invention is protection apparatus for a person participating in a sport wearing shoulder pads including rigid panels on shoulders of the person to distribute a downwardly directed force over an area of the person's body. The apparatus includes a helmet fitting over the head of the person. The helmet includes a rigid outer shell of a size and shape to encompass a major portion of the person's head. The shell includes an inside surface having an inside side surface section around the perifery of the inside surface, and an outer surface having a lower section. The helmet includes padding means on the inside surface of the shell to provide a cushion against the person's head, said means defining an interior padded cavity bounded by an upper padded interior surface. The helmet further includes a cap of a size and shape to extend over an upper portion of the person's head and attachment means connecting the cap peripherally to the inside side surface section of the shell and providing elastic resistance against movement of the cap upwardly a first distance to the upper padded interior surface The helmet also includes an rigid annular collar attached to and extending outwardly from the lower section of the outer surface of the shell, the collar comprising a firm lower horizontal surface with an outer partial circular edge The apparatus further includes force distribution means on shoulders of the person to distribute a downwardly directed force over an area of the person's body, and a pair of vertical members attached on top of the force distribution means, each of the members positioned over opposite shoulders of the person and including an upper end surface positioned a second distance under the lower horizontal surface of the collar. Again the first distance is less than the second distance.

DESCRIPTION OF PREFERRED EMBODIMENTS

Figure 1:
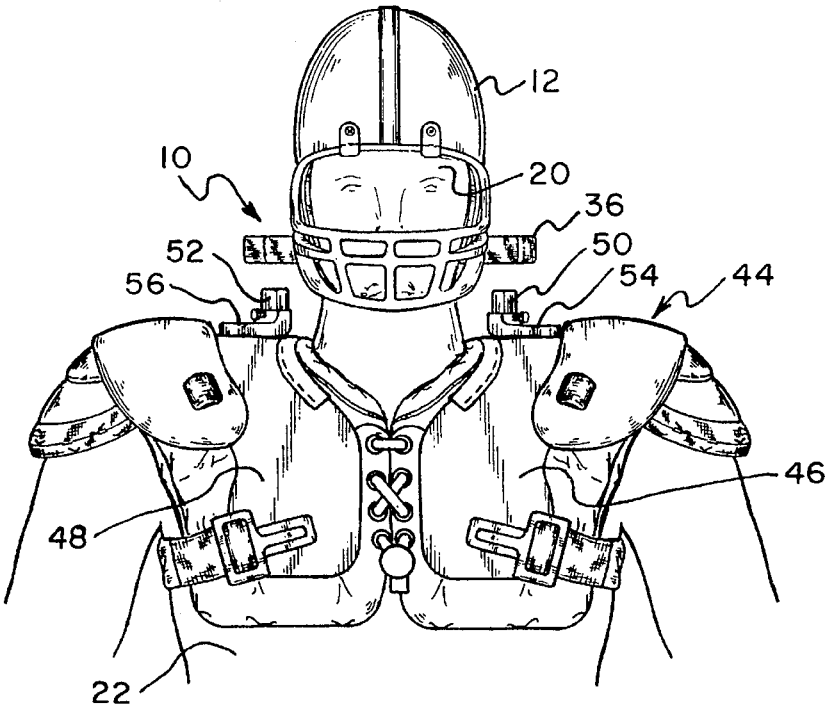
FIG. 1 is a front view of a device of the present invention on a football player.
Figure 3:
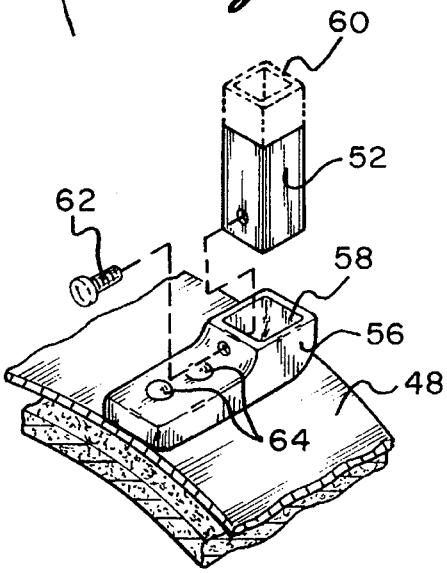
FIG. 3 is an expanded cutaway perspective view of a stop illustrated in FIG. 1.
Figure 2:
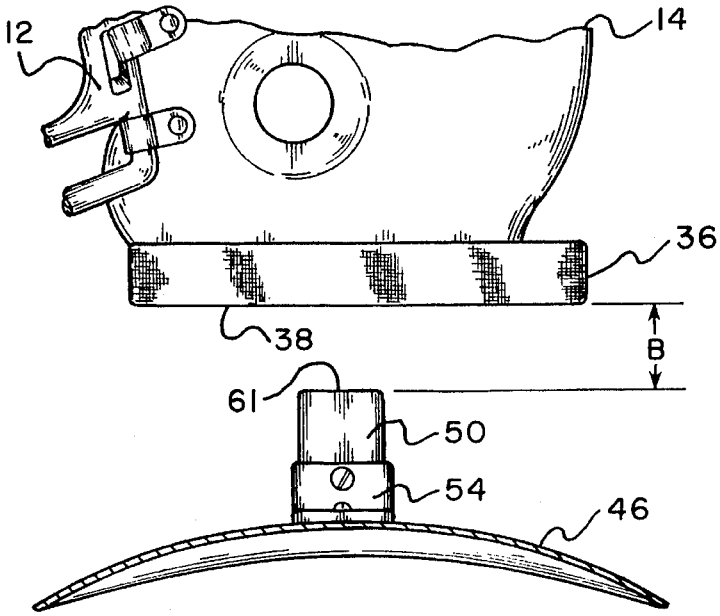
FIG. 2 is a partial cutaway right side view diagramming the relative positions of the elements.
Figure 4:
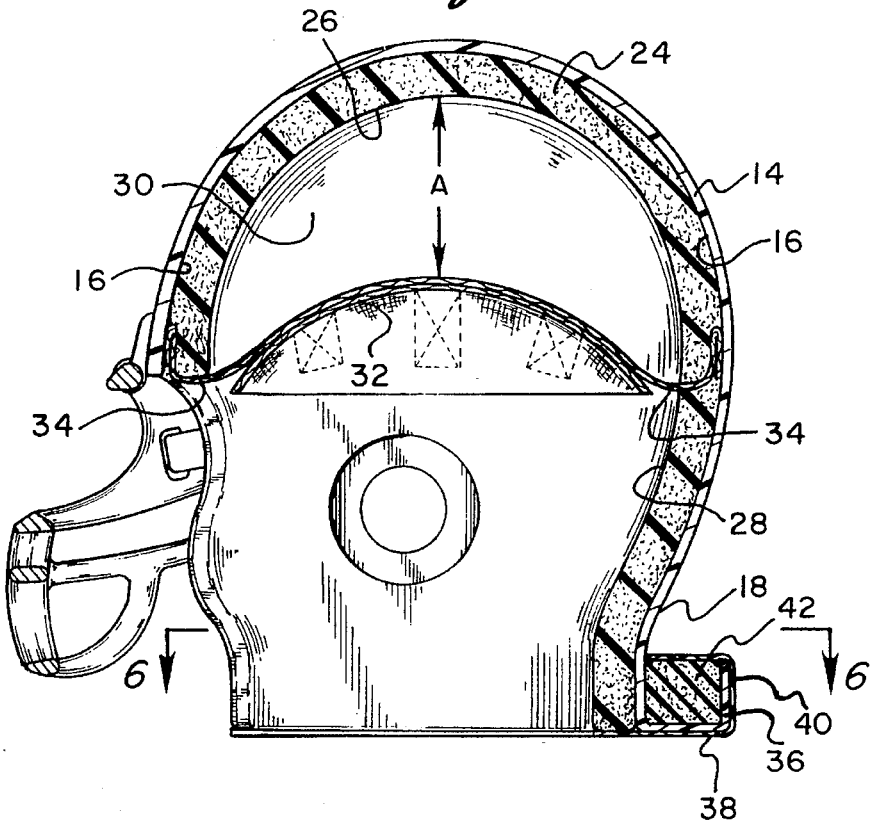
FIG. 4 is a vertical cross sectional view of the helmet shown in of FIG. 1.
Figure 5:
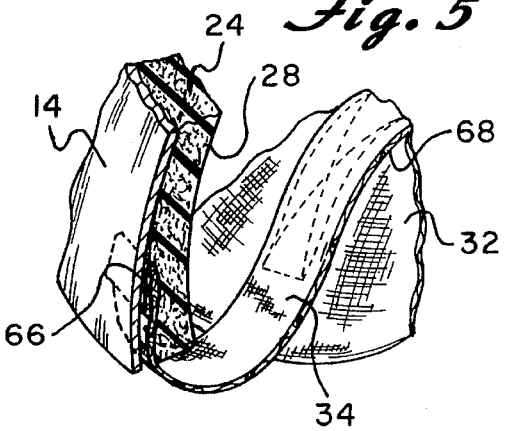
FIG. 5 is an expanded cutaway perspective view of a connection of the head protection apparatus in the helmet.
Figure 6:
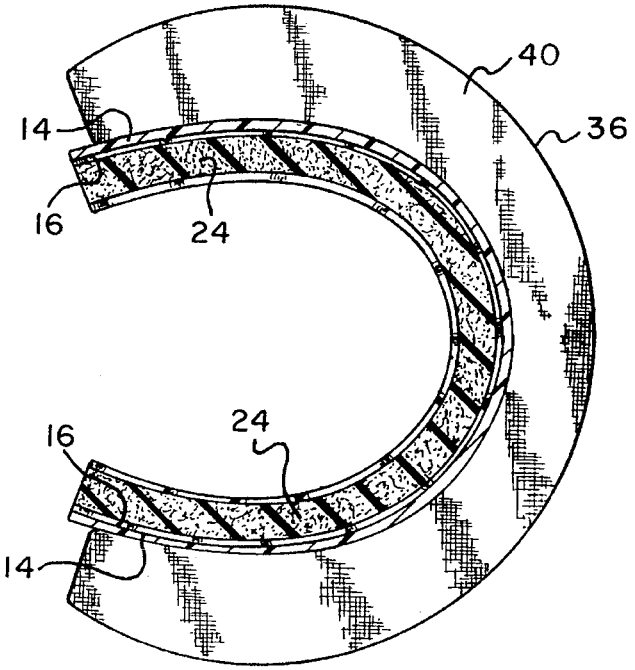
FIG. 6 is a horizontal cross sectional view taken along lines 6—6 of FIG. 4.

Apparatus 10 is illustrated in FIGS. 1 through 5 including a modified helmet upright posts, one on each shoulder, and a forced distribution mechanism to the shoulders of the participant. Helmet 12 includes shell 14 constructed of high impact polymeric plastic such as ABS copolymer, polypropylene, polycarbonate, or like tough polymeric plastic materials. The shape of shell 14 has an increased height and an enlarged interior cavity within the shell compared with standard football helmets. The shell includes inside surface 16 to which standard foam padding 24 is adhesively attached. Padding 24 essentially protects the head from reaching the inside surface of the shell without compressing the foam. Shell 14 also includes lower section 18 which continues around the lower portion of the shell on both sides and in the rear. Interior cavity 30 is bounded by side padded interior surface 28 which extends around the sides and in the rear of the helmet. Cavity 30 is also bounded by upper padded interior surface 26 which extends over the upper portion of the helmet. Head 20 of person 22 rests against surface 28, the padding of the side padded interior surface, but the upper portion of head 20 does not touch surface 26. Cap 32 is constructed of breathable fabric or a plastic configuration and may or may not be elastic in nature. It is preferred that all the elasticity be obtained through elastic straps 34 which are attached around the periphery of cap 32 to inside surface 16 of section 18 of the shell. Attachment of strap 34 is made to the inside of shell 14 on the same side of the strap that is attached to cap 32. As shown in FIG. 5, end 66 on the underside of strap 44 is attached to surface 16 while median section 68 of strap 44 is stitchably attached to cap 32. In this embodiment strap 34 extends all the way across the top of cap 34 and attaches on the other side of shell 14 on surface 16. The composition and structure of straps 34 are chosen to provide substantial elastic resistance to upward movement of the person's head. The resistance is chosen to provide sufficient resistance that the head will not move upwardly to reach surface 26 except in the most severe blows were the stop mechanism described below not be present. More specifically, the resistance will largely prevent upward movement of the person's head as a result of sideway blows to the helmet. However, the elastic resistance is intended to allow for a major movement of the cap upwardly when the blow is severe and directed downwardly on the top of the helmet. When the helmet is worn, the distance between the top of the cap (essentially the top of the head) and upper surface 26 is depicted as distance "A" in FIG. 5. In this embodiment, the distance is about three inches. Annular collar 36 is formed as an integral extension of helmet shell 14 extending horizontally outwardly from lower section 18 to the sides and to the rear of the helmet. The horizontal width of collar 36 varies and is longest (about two inches) to the sides as the outside edge of the collar is circular and is only open to the front of the helmet. Collar 36 has lower horizontal surface 38 which contacts posts 50 and 52 when a hard blow is struck to the top of helmet 12. Foam core 42 is placed inside the cup-shape of collar 36 and the entire collar is covered with fabric 40 to simulate the common collars used by football players. Shoulder pads 44, have several common elements of the standard football shoulder pad unit. Shoulder pads 44 include left rigid panel 46 and right rigid panel 48, each formed to fit over the wearer's shoulders extending frontwardly to the chest and rearwardly to the back of the wearer. The material is of rigid plastic or like material that will distribute force applied directly downwardly to a relatively large area of the wearer's body. Right vertical post member 52 as illustrated in FIG. 3 and left vertical post member 50 as illustrated in FIG. 2 extend respectively upwardly from the right and left shoulders of the person. Members 50 and 52 connect into left bracket 54 and right bracket 56, respectively. As shown in FIG. 3, right vertical member 52 interfits into female cavity 58 of bracket 56 which in turn is attached by rivets 64 to rigid panel 48. Bolt 62 connects through an aligned hole in bracket 56 into a threaded hole of member 52 to hold it in place. Each vertical post member has an upper bearing surface which is aligned laterally about midway of the width of lower horizontal surface 38 of collar 36. Upper bearing surfaces 60 and 61 of members 32 and 30, respectively, are each positioned about two inches below surface 38 and that distance is as represented by "B" as shown in FIG. 2. Although the exact distances "A" and "B" are not critical, it is important that distance "A" be greater than distance "B" and it is preferred that that distance be about one inch. As the distance difference is reduced below one-half inch, the elasticity of the connection of cap 32 becomes more critical. As the distance difference is increased above an inch and a half, the need for a larger and, specifically a higher helmet comes more unwieldy. Further, as distance "A" is increased, a larger helmet is necessary and as distance "A" is reduced, it is necessary to reduce distance "B" which tends to restrict the normal movements of the player. If distance "B" is maintained at about two inches, there is little or no restriction of head movement by the player. Upon a heavy impact to the top of the helmet, the helmet moves downwardly and the head approaches upper surface 26. This movement is resisted by the elasticity of straps 34 until the head is about one inch from surface 26 at which time end surfaces 60 and 61 come into contact with lower surface 38 of collar 36 distributing most of the force downwardly onto the shoulders of the player.

The shape of members 50 and 52 is not critical and modifications to round off and thicken these members will not affect the performance of the device, but will make it more difficult to grab onto during play. If members 50 and 52 are of the shape as shown, it would be necessary to penalize players grabbing onto those projections. Squatter members would probably not be able to be gripped by an opposing player. The length of members 50 and 52 are adjusted to the size of the player. For players with longer necks, longer members are necessary. For players with well-developed shoulders and shorter necks, shorter vertical members are used. A trainer would measure the size necessary and attach the proper length for that player. Although not pictured, a rubber cap on the top of surfaces 60 and 61 will increase the coefficient of friction between that surface and horizontal surface 38 of collar 36 to prevent significant slippage.

While this invention has been described with reference to specific embodiments disclosed herein, it is not confined to the details set forth and the patent is intended to include modifications and changes which may come within and extend from the following claims.

I claim:

1. A protection apparatus to be worn by a person participating in a sport, the apparatus comprising:

(A) a helmet fitting over the head of the person, the helmet comprising:

(i) a rigid outer shell of a size and shape to encompass a major portion of the person's head, the shell comprising:

(a) an inside surface defining an interior cavity bounded by an inside upper surface section and, an inside side surface section around the perifery of the inside surface, and (b) an outer surface having a lower section, (ii) a cap of a size and shape to extend over an upper portion of the person's head, (iii) attachment means connecting the cap peripherally to the inside side surface section of the shell and providing elastic resistance against movement of the cap upwardly a first distance to the inside upper surface section of the shell, and (iv) a rigid annular collar attached to and extending outwardly from the lower section of the outer surface of the shell, the collar comprising a firm lower horizontal surface, (B) force distribution means on shoulders of the person to distribute a downwardly directed force over an area of the person's body, and (C) a pair of vertical members attached on top of the force distribution means, each of the members positioned over opposite shoulders of the person and comprising an upper end surface positioned a second distance under the lower horizontal surface of the collar, wherein the first distance is less than the second distance.

2. The apparatus of claim 1 wherein the helmet also comprises padding means on the interior surface of the shell to provide a cushion against the person's head, said means defining the interior cavity.

3. The apparatus of claim 1 wherein the firm lower horizontal surface of the collar comprises an outer partial circular edge.

4. The apparatus of claim 1 wherein the difference between the first distance and the second distance is about one inch.

5. The apparatus of claim 4 wherein the first distance is about two inches and the second distance is about three inches.

6. The apparatus of claim 1 wherein the force distribution means comprises shoulder pads comprising rigid panels on shoulders of the person.

7. The apparatus of claim 1 wherein the annular collar is an integral extension of the shell extending outwardly from a lower edge of the lower section of the shell.

8. The apparatus of claim 1 wherein the apparatus further comprises a pair of brackets attached on top of the force distribution means, each bracket over opposite shoulders of the person and the vertical members interfit into and are detachably attached to each respective bracket.

9. The apparatus of claim 8 wherein the pair of vertical members are of a chosen length to attain the second distance.

10. The apparatus of claim 1 wherein the attachment means connecting the cap peripherally to the inside side surface section of the shell comprises a plurality of elastic straps, each strap attached at a first end abutting a first surface to the cap and at a second end abutting the first surface to the shell.

11. Protection apparatus for a person participating in a sport wearing shoulder pads comprising rigid panels on shoulders of the person to distribute a downwardly directed force over an area of the person's body, the apparatus comprising:

(A) a helmet fitting over the head of the person, the helmet comprising:

(i) a rigid outer shell of a size and shape to encompass a major portion of the person's head, the shell comprising:

(a) an inside surface having an inside side surface section around the perifery of the inside surface, and (b) an outer surface having a lower section, (ii) padding means on the inside surface of the shell to provide a cushion against the person's head, said means defining an interior padded cavity bounded by an upper padded interior surface, (iii) a cap of a size and shape to extend over an upper portion of the person's head, (iii) attachment means connecting the cap peripherally to the inside side surface section of the shell and providing elastic resistance against movement of the cap upwardly a first distance to the upper padded interior surface, and (iv) a rigid annular collar attached to and extending outwardly from the lower section of the outer surface of the shell, the collar comprising a firm lower horizontal surface with an outer partial circular edge, (B) force distribution means on shoulders of the person to distribute a downwardly directed force over an area of the person's body, and (C) a pair of vertical members attached on top of the force distribution means, each of the members positioned over opposite shoulders of the person and comprising an upper end surface positioned a second distance under the lower horizontal surface of the collar, wherein the first distance is less than the second distance.

12. The apparatus of claim 11 wherein the annular flange is an integral extension of the shell extending outwardly a lower edge of the the lower section of the shell.

13. The apparatus of claim 11 wherein the apparatus further comprises a pair of brackets attached on top of the rigid panels of the shoulder pads, each bracket positoned over opposite shoulders of the person and the vertical members interfit into and are detachably attached to each respective bracket.

14. The apparatus of claim 13 wherein the pair of vertical members are of a chosen length to attain the second distance.

15. The apparatus of claim 11 wherein the attachment means connecting the cap peripherally to the inside side surface section of the shell comprises a plurality of elastic straps, each strap attached at a first end abutting a first surface to the cap and at a second end abutting the first surface to the shell.

16. The apparatus of claim 11 wherein the difference between the first distance and the second distance is about one inch.

17. The apparatus of claim 16 wherein the first distance is about two inches and the second distance is about three inches.

* * * * *